US006390906B1

(12) United States Patent
Subramanian

(10) Patent No.: US 6,390,906 B1
(45) Date of Patent: May 21, 2002

(54) FLEXIBLE ABRASIVE BELTS

(75) Inventor: Krishnamoorthy Subramanian, Groton, MA (US)

(73) Assignee: Saint-Gobain Abrasives Technology Company, Worcester, MA (US)

( * ) Notice: Subject to any disclaimer, the term of this patent is extended or adjusted under 35 U.S.C. 154(b) by 127 days.

(21) Appl. No.: 09/110,824

(22) Filed: Jul. 6, 1998

(51) Int. Cl.[7] ..... B24B 1/00

(52) U.S. Cl. ..... 451/296

(58) Field of Search ..... 451/296, 449, 451/489, 527

(56) References Cited

U.S. PATENT DOCUMENTS 2,178,381 A * 10/1939 Trinkle ..... 51/187
2,189,754 A * 2/1940 Cherrington ..... 51/188
2,838,890 A * 6/1958 McIntyre ..... 51/185
4,486,200 A * 12/1984 Heyer et al. ..... 451/532 X

* cited by examiner

*Primary Examiner*—Joseph J. Hail, III
*Assistant Examiner*—Anthony Ojini
(74) *Attorney, Agent, or Firm*—David Bennett

(57) ABSTRACT

Providing an abrasive belt with a pattern of holes through the abrasive-containing layer greatly increases the flexibility of the belt and reducing the need for flexing to generate a pattern of potentially destructive cracks in the abrasive surface.

6 Claims, 1 Drawing Sheet

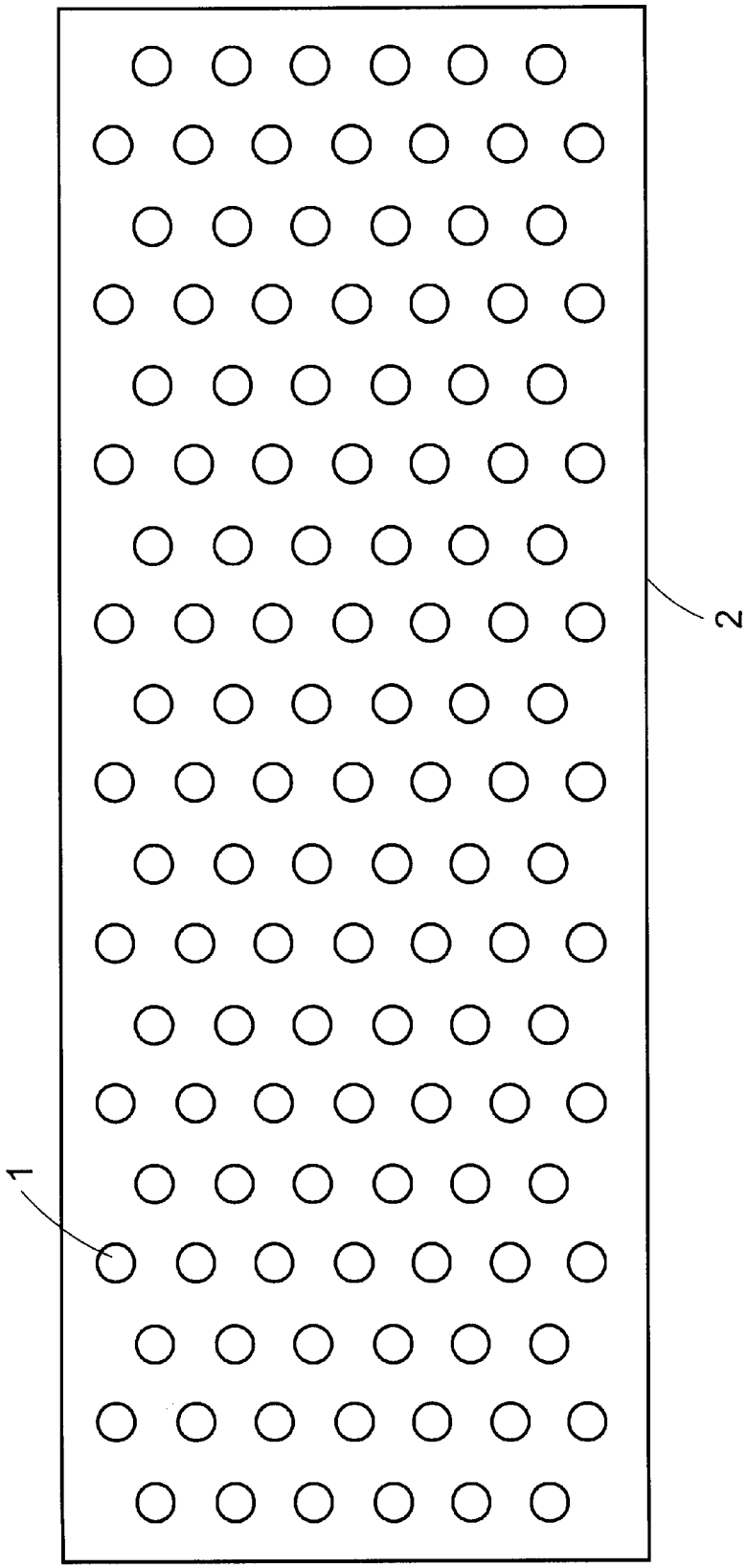
1
2

FLEXIBLE ABRASIVE BELTS

BACKGROUND OF THE INVENTION

An abrasive belt typically comprises a backing material which may be pretreated to close up any porosity in the structure with a polymerizable resin having a filler dispersed therein; a resin-based maker coat upon which are deposited abrasive grains before the resin is cured; and a resin-based size coat that helps anchor the abrasive grain to the substrate. Optionally a resin-based supersize coat may overlay the size coat. Thus a typical abrasive belt may have from 2 to about 4 resinous layers deposited thereon and cured in place. Since particularly the maker and size coats need to hold the abrasive grains very tightly if they are to do an effective job during grinding, the resins used in these coats at least tend to be very hard and inflexible. The most typical resin used for all the coats is a phenolic resin since this has high temperature resistance, is cheap and has all the necessary hardness properties.

A consequence of these multiple layers of hard inflexible resin is that the belts themselves become very stiff and inflexible and since belts must necessarily pass around pulleys when in action, this raises a problem. Traditionally to alleviate this problem the belt is flexed around a mandrel to induce a plurality of cracks in the cured resin binders which allow the belts to pass around pulleys. This is an effective route but it does cause the initiation of uncontrolled cracks in the surface that can propagate with disastrous results.

An alternative solution is to use resin binders with a degree of flexibility but this is always a matter of compromise since such resins do not hold the grits as tightly while under the pressures encountered during grinding.

A further alternative is to provide that the abrasive bearing portions of the backing are separated by portions of backing with little or no binder or abrasive. This approach has been attempted several times, for example in U.S. Pat. Nos. 2,001,191; 2,907,196; 5,014,468; 5,304,223; Japanese 2-83872 and Japanese 4-159084.

The purpose of this invention is to propose a further solution to this problem with the added advantages that it requires minimum disruption to existing processes and can be simply added to conventional production. It requires no flexing or cracking of the abrasive layers such that no crack pattern is developed. It is also adaptable to use with binders made from the conventional thermosetting resins that have proved the workhorse of the coated abrasives production for many years.

DESCRIPTION OF THE INVENTION

The present invention provides a coated abrasive belt in which a pattern of holes is created in at least the abrasive-bearing portions of the belt in locations and in numbers sufficient to provide improved flexibility to the belt.

The term "hole" is used to convey the concept of a portion of the surface from which the abrasive bearing component is removed and which is surrounded by unmodified surface.

Since the source of the stiffness of an abrasive belt is primarily the abrasive containing layers, (including the maker, size and optional supersize coats), it is only necessary that the holes penetrate though this abrasive containing layer. In practice however it is simpler and therefore often preferred that the holes penetrate the fall thickness of the belt. This in itself confers a secondary benefit in that the belt can ran cooler because of the access of air to the grinding surface through the holes.

However while the hole often passes through the full thickness of the belt, it can also pass through just the portion of the belt represented by material deposited on the belt backing. The shape of the hole in vertical cross-section is frequently a right cylinder. Often however a stepped hole with the narrowest diameter passing through or at least adjacent the backing give a suitable combination of flexibility and retained structural strength in the backing material.

The holes in horizontal cross-section are most conveniently round but nothing in the nature of the invention dictates a round shape, and therefore square, oval or polygonal shapes can be used. Most frequently the holes are identical in size and shape though this is not essential. The pattern of the holes is conveniently in lines across the width of the belt with adjacent lines staggered such that, in the longitudinal direction, a line through the center of a hole in one line of holes will intersect a hole in, for example every second or every third, line of holes across the width of the belt. This ensures that, in the direction or travel of the belt, an equal surface area of abrasive is encountered at all points across the width of the belt except for a-region at the edges where holes may be omitted to preserve the integrity and strength of the belt in that region.

The size of the holes used represents a balance between a number of factors including (on the negative side), the grinding surface sacrificed and the weakening of the integrity of the belt; and (on the positive side), the increased flexibility, the cooler running and the decreased susceptibility of the belt to uncontrolled crack propagation. If the holes are too small they can become blinded by swarf such that the cooling effect is reduced. It is therefore preferred to have larger and fewer holes rather than smaller and more holes. For example a hole's greatest dimension in the belt width direction in preferred belts can suitably be from 3 to 8% such as from 4 to 6% of the width of the belt. However if flexibility is the primary requirement and cooling is of secondary performance, small holes may be the preferred alternative.

In general it is preferred that, for a line drawn through the centers of the holes in a line of holes and from edge to edge of the belt has a length wherein 50% or less, such as from 25 to 50%, of the length intersects a hole. More preferably this maximum hole intersect length figure is 40% or less, such as about 35%, of the length of the line. This preferably applies to lines drawn across the belt width and therefore perpendicular to the direction of movement of the belt and also to lines drawn diagonally, at an angle less than 90° to the width dimension.

In a preferred belt according to the invention the hole spacing is preferably closest in the width dimension of the belt and here the line drawn across the width and through holes with centers located along that line will intersect holes along 40 to 50% of its length, whereas a line at 45° to the width line would intersect holes over a maximum of about 35% of its length. Clearly the maximum intersection occurs when the lines passes through the centers of all holes along that line. The minimum hole intersect length would be zero when the line passes between holes or tangentially to all holes.

Belts having such lines of holes are found to be more flexible than unflexed belts with exactly the same backing and amounts of the same abrasive, maker, size and supersize formulations applied to the backing and cured. By this is meant that less energy is needed to bend a straight strip of the product such that the ends of the strip come into but-end contact with one another.

The holes can be generated by any convenient means including the use of hole punches and, where the hole does not need to penetrate the backing, a de-burring tool which can be adapted to remove a layer of the desired thickness. Non-contact means can also be used such as for example a water-jet device, a laser beam and the like. It is also possible to provide that the backing is pre-treated to prevent adhesion of the maker coat to the backing such that the portion of the abrasive-containing layer deposited on such spots can be readily removed. It is also possible to prevent cure of the binder in the areas where removal is required such that removal is facilitated. There is therefore no essential process by which the hole must be created.

DRAWING

FIG. 1 represents a vertical view of a portion of the top of a belt according to the invention.

DESCRIPTION OF THE PREFERRED EMBODIMENT

The invention is now described with specific reference to the embodiment shown in FIG. 1 which illustrates one preferred belt according to the invention. There are many other possible arrangements of holes to satisfy the requirements of the invention such that FIG. 1 should not be taken as implying any unrecited limitation to the scope of the invention.

In FIG. 1, holes, 1, pass through the full thickness of the belt and are arranged in rows across the width of the belt, 2, with the holes in adjacent rows being staggered with respect to the holes in the adjacent rows. Any three adjacent holes form an isosceles triangle but not an equilateral triangle because the holes in the same row in the width direction are closer together than to any hole in an adjacent row.

In FIG. 1 the location of the holes in any row with respect to the edge across the width repeats every other row but sometimes it is preferred to have the locations repeat every third row or even every fourth row.

What is claimed is:

1. An abrasive belt comprising a backing material and, adhered to a major surface thereof, an abrasive bearing layer, said belt having a pattern of holes therein which pass through at least the abrasive-bearing layer of the belt, in locations and in numbers sufficient to provide improved flexibility to the belt.

2. An abrasive belt according to claim 1 wherein the holes are arranged in a plurality of rows across the width of the belt with adjacent rows staggered with respect to adjacent rows such that a line parallel to an edge of the belt and passing through the center of a first hole in a first row of holes will intersect a hole in a row of holes that is from two to four rows removed from the first row.

3. An abrasive belt according to claim 2 in which, in any row of holes across the width of the belt, a line drawn through the centers of the holes intersects one of the holes in said row over from 25 to 50% of its length.

4. An abrasive belt according to claim 2 in which adjacent holes in a first row across the width of the belt are separated by a distance that is shorter than the distance between a hole in the first row and the nearest hole in any adjacent row.

5. An abrasive belt according to claim 1 in which the holes are round.

6. An abrasive belt according to claim 1 in which the holes also penetrate through the backing material.

* * * * *